United States Patent [19]

Gibson

[11] Patent Number: 4,879,028

[45] Date of Patent: Nov. 7, 1989

[54] DEBRIS DIVERTING BOOM

[76] Inventor: John Gibson, R. R. #3, Campbellville, Ontario, Canada, L0P 1B0

[21] Appl. No.: 238,219

[22] Filed: Aug. 30, 1988

[51] Int. Cl.[4] ..... E04H 3/20

[52] U.S. Cl. ..... 210/169; 210/236; 210/242.1; 210/249

[58] Field of Search ..... 210/169, 236, 242.1, 210/249, 523, 525, 776, 242.3, 923; 72/368, 379; 248/295.1

[56] References Cited

U.S. PATENT DOCUMENTS

| | | | |
|---|---|---|---|
| 1,634,562 | 7/1927 | Shapiro | 72/379 |
| 2,539,237 | 1/1951 | Dreyer | 72/368 |
| 3,152,076 | 10/1964 | Kreutzer | 210/242.1 |
| 3,244,284 | 4/1966 | Shaffer | 210/242.1 |
| 3,774,767 | 11/1973 | Field | 210/169 |
| 4,068,327 | 1/1978 | Heinlein | 210/169 |
| 4,221,662 | 9/1980 | Joseph | 210/169 |
| 4,379,749 | 4/1983 | Roth | 210/169 |
| 4,455,695 | 6/1984 | Mikhel | 210/169 |
| 4,557,001 | 12/1985 | Burkhart | 210/169 |
| 4,720,340 | 1/1988 | O'Brien | 210/169 |

FOREIGN PATENT DOCUMENTS

| | | |
|---|---|---|
| 3509660 | 9/1986 | Fed. Rep. of Germany . |
| 0361209 | 11/1931 | United Kingdom . |

*Primary Examiner*—Peter Hruskoci
*Assistant Examiner*—Christopher Upton
*Attorney, Agent, or Firm*—Rogers & Scott

[57] ABSTRACT

The invention provides a debris diverting boom for use in diverting debris floating on the surface of a body of water toward a side skimmer opening thereof to facilitate its removal before it becomes waterlogged and sinks to the bottom. The body of the boom takes the form of a hollow cylindrical elongated body portion and an integral downwardly-extending skirt portion preferably produced by roll-forming from a narrow elongated strip of metal. The interior of the hollow body portion is filled with a tubular piece of closed-cell foam to provide the necessary buoyancy. The lower edge of the skirt is folded over to hide the raw metal edge and crimped to a regular pattern to increase its rigidity and to hide the random wrinkling of the material created by the folding process. The tube and skirt ends are covered with plastic caps for the same purpose. Alternatively, the boom is formed from plastic material by extrusion or foaming. A bracket to hold the boom at the required angle to the side of the pool or tank consists of an elongated rod having at both ends respective sets, each of at least two longitudinally-spaced, parallel, downwardly extending rods which extend through corresponding spaced vertical holes in the boom and the pool side. These prevent the boom and the bracket from rotating in the horizontal plane, and yet provide for vertical movement of the boom on the bracket; the rod is not too stiff so as to provide a certain amount of "spring" if the boom is impacted by a swimmer.

19 Claims, 3 Drawing Sheets

FIG.3
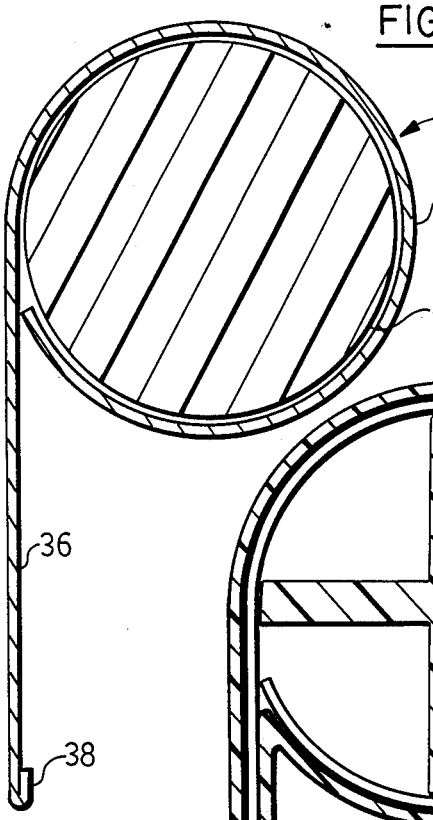
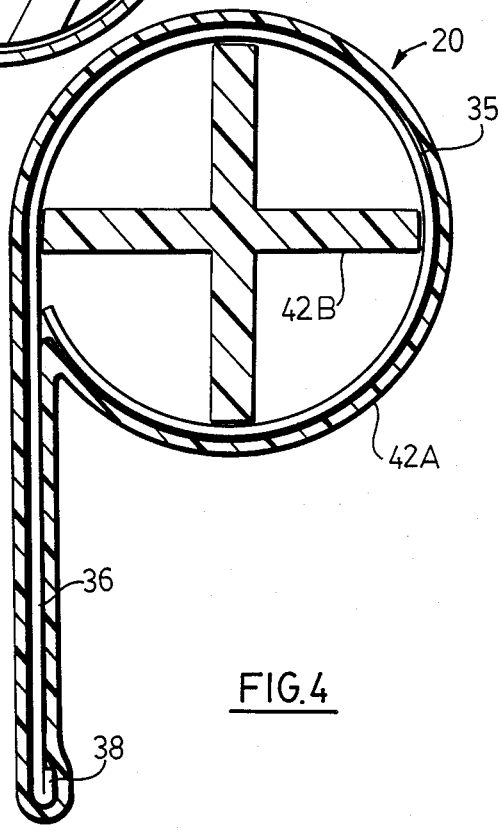
FIG.4

DEBRIS DIVERTING BOOM

FIELD OF THE INVENTION

This invention relates to a debris diverting boom to aid in capturing debris floating on the surface of a body of water, and more particularly, to the construction and mounting of such a boom.

REVIEW OF THE PRIOR ART

The average swimming pool receives all manner of debris, from windblown dirt, dust and leaves to even the occasional small animal. Most of the debris floats on the surface for at least a short period of time before becoming waterlogged and sinking to the bottom. Virtually all pools of any substantial size are provided with a system for circulating the water and including a filtering system intended to remove any debris in the water. They usually consist of a skimmer disposed at one side of the pool and including a weir over which the water flows to the filter, and from there to a pump which returns the water to the pool through a nozzle or nozzles spaced appropriately away from the skimmer, and arranged to cause a circulation of the water around the pool. In practice the skimmer is only able to capture debris within about 20–30 cm (8–12 ins.) of its entrance, and moreover the system can only remove the debris entering a pool before it sinks below the level of the weir, and inevitably a certain amount of debris does sink too far before it can be removed, and this must be removed manually with a net or a vacuum system. It is therefore advantageous to collect as much of the debris as possible with a surface debris collecting system while it is still floating. It is known therefore to place a fixed or floating diverting boom in the surface portion of the water flow in a pool in order to more efficiently divert the floating debris into the skimmer inlet before it can sink. Such a boom usually is placed with its inboard or inner end fixed adjacent and in line with the skimmer inlet, and with its outboard or outer end upstream of the skimmer inlet so that the boom makes an angle less than a right angle with the liquid flow. When fixed in this manner the debris engages the boom and is moved by the water flow along it into the skimmer inlet more quickly than would otherwise occur; in particular the boom is much more effective in diverting the debris in the center portion of the body of water toward the skimmer inlet at the pool edge.

U.S. Pat. No. 3,152,076 to Kreutze shows and describes a device comprising a floating tubular wand which is fixed to the coping of a pool by a semi-permanently mounted bracket. The bracket consists of a clamp which grips the coping, and a ribbed vertical shank on which the wand is mounted so that it is free to move up and down the shank as the pool water level changes, rotation around the shank being prevented by the ribs. The wand can be removed from the pool for swimming by slipping it off the lower end of the shank. The nature of the mounting is such that if the wand is not removed an accidental bump can lead to it being bent and/or the swimmer being hurt if the impact is at all heavy. In addition, the mounting bracket, which is not removed for swimming, provides a hazard for the unwary swimmer. Further, the tubular cross-section of the wand may allow some debris to pass underneath it.

U.S. Pat. No. 3,774,767 to Field discloses a skimmer trap including a boom consisting of a buoyant tubular member with a downwardly-projecting, water-flowinterrupting flat strip affixed to the upstream face thereof, the flat strip preventing debris from passing underneath the skimmer trap. At the inner end of the trap the tubular member is bent so that it lies parallel to the pool wall facing downstream, while the flat strip is bent at right angles to this member to engage in the skimmer. The portion of the flat strip which engages with the skimmer prevents the inboard end of the skimmer trap from moving downstream, while the upstream end is held in place against the water flow by a flexible line affixed to a small weight which sits on the pool deck. Such an arrangement provides a very flexible mounting to the pool edge, so that the skimmer trap can move to minimize injury should a swimmer accidentally hit it. However, the mounting arrangement provides only minimal height adjustment to compensate for water level fluctuations and the flat strip presents many sharp edges which can cut an uncautious swimmer.

DEFINITION OF THE INVENTION

It is a principal object of the present invention to provide a simple effective debris diverting boom which is relatively easily manufactured.

It is another principal object to provide such a boom which can be easily mounted or removed in a manner which takes account of the possibility of unwanted impact contact by a swimmer.

In accordance with the present invention there is provided a debris diverting boom for diverting debris floating on the surface of a body of a liquid circulating in a tank or pool toward the edge thereof, said boom comprising:

an elongated hollow tubular body portion and an integral elongated skirt portion;

flotation means within the interior of the hollow tubular body portion and providing sufficient buoyancy to the boom to keep it afloat; and bracket means for holding said boom in place extending across said circulating liquid at an angle to the liquid flow.

Also in accordance with the invention there is provided a debris diverting boom for diverting debris floating on the surface of a body of a liquid circulating in a tank or pool toward the edge thereof, said boom comprising:

an elongated tubular body portion of sufficient buoyancy to keep it afloat; and bracket means for holding said boom in place extending across said circulating liquid at an angle to the liquid flow, the bracket means comprising an elongated member extending lengthwise of the boom and having, a boom-engaging portion and a pool-side engaging portion, the member having at its boom-engaging portion at least two longitudinally-spaced parallel rods extending vertically downwardly therefrom to pass through corresponding longitudinally spaced vertical holes in the boom, thus allowing the boom to rise and fall with the liquid level but preventing the boom from turning in a horizontal plane relative to the bracket.

DESCRIPTION OF THE DRAWINGS

An embodiment of the invention will now be described, by way of example, with reference to the accompanying diagrammatic drawings wherein:

FIG. 3 is an enlarged cross-section through the boom of FIG. 1, taken along line 3—3 therein;

FIG. 4 is an enlarged cross-section through an end cap of the boom of FIG. 1, taken along line 4—4 therein.

DESCRIPTION OF THE PREFERRED EMBODIMENT

Although the embodiment will be described in the context of keeping the surface of a swimming pool clean, it may also be used in commercial and industrial applications, where debris must be removed from the surface of a body of liquid circulating in a tank or pool.

Figure 1:
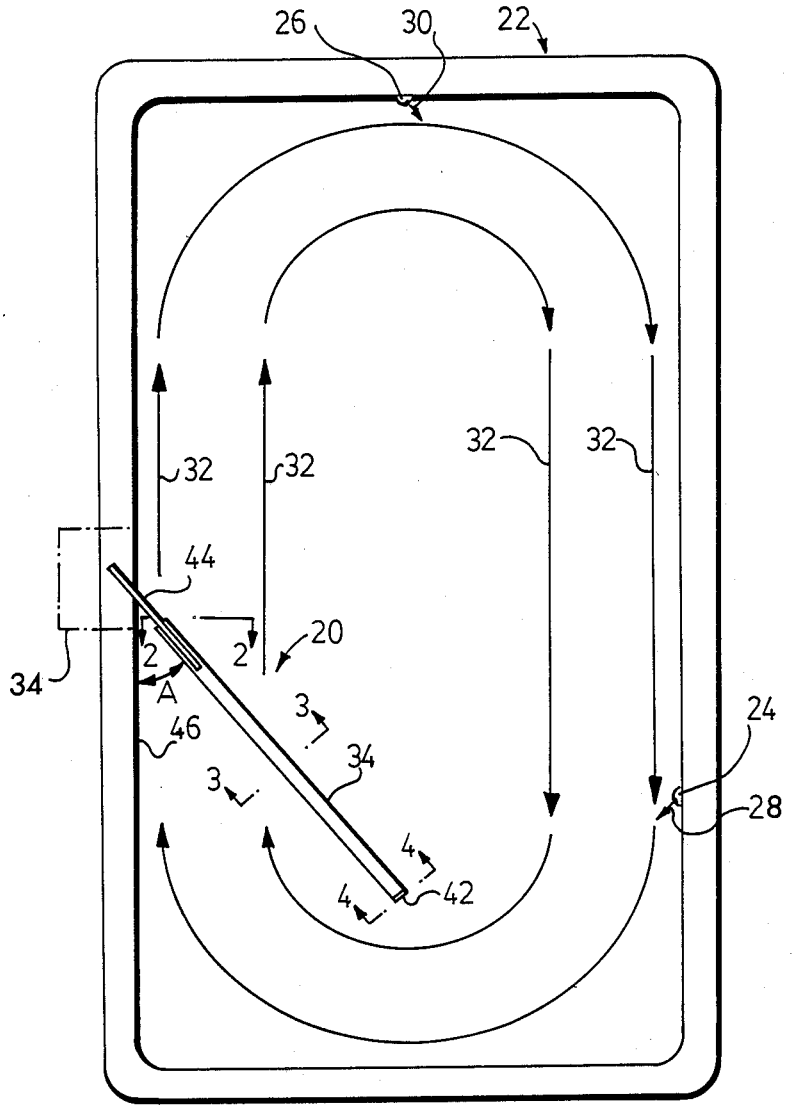
FIG. 1 is a plan view of a typical swimming pool showing a debris collecting boom of the invention is use therein.

FIG. 1 shows a debris diverting boom 20 according to the invention in use in a swimming pool 22. The boom is intended to function in pools of the type in which there is continuous circulation of the water by means of one or more nozzles injecting water into the pool, and a weir-type skimmer removing the water and any floating debris entrained therewith and delivering it to a filter and circulating pump. The pool shown in FIG. 1 has two such water injection nozzles 24 and 26 which point in the direction of the respective arrows 28 and 30. In this embodiment the nozzles circulate the pool surface water in a clockwise direction around the pool as seen in FIG. 1, as shown by the arrow 32. The nozzles are usually for convenience in installation spaced quite close to the surface, and accordingly the circulation is predominantly at the surface of the pool. A weir type skimmer 34 is inset in one wall of the pool at a position to set the level of the water in the pool, the skimmer also catching debris which floats on the surface of the pool and is carried to the skimmer by the currents set up by these nozzles.

The boom 20 is disposed with its inner end at least approximately in line with the upstream end of the skimmer 34 and inclined at an angle to the pool wall, the boom being sufficiently long that it intercepts the circulating surface water and the debris entrained therewith and directs it from the center portion of the pool to the outside edge and into the skimmer 28, to be filtered and returned to the pool via water nozzles 28, 30. Without the boom in place most of the debris circulating in the pool portion would sink below the skimmer level and it could not reach the skimmer opening; the boom helps prevent this by diverting the circulating debris to the skimmer opening much more quickly and with a much more extended reach than would otherwise be the case.

For maximum effectiveness the boom length should be such that it extends approximately at least one half of the pool width, and it should be positioned with its inboard end from about 4 to about 12 inches, more usually about 5 or 7 inches away from the pool side, so that relatively large objects, such as large leaves, will be able to enter the strainer and not become wedged between the boom end and the pool side. The boom is disposed so that its outboard end which is further from the pool side is placed upstream and with the "upstream" angle A somewhat less than 90°. The boom will function when placed at angles from about 10 to 80 degrees but it is most efficient when used at an angle of approximately 45° to the water flow. Since the boom is disposed at an angle its effective length is less than its actual length; some reduction below half the pool width can be tolerated but with a consequent reduction in collecting efficiency.

The design and construction of such a boom has proven to be unexpectedly difficult in order to produce a commercially acceptable product, as evidenced by the lack of such booms on the market, despite their obvious advantages and the number of prior proposals that have been made. Thus, as a typical consumer product they must be relatively inexpensive, but yet sturdy enough to withstand repeated installation and removal, since it is intended to be removed before swimming and subsequently replaced. The manner of installation and removal must also therefore be relatively sturdy and be possible without the use of tools. In addition it must be constructed to take account of the possibility that some swimmers may enter the pool without taking the trouble to remove the boom, and may thereafter inadvertently bump into the boom with quite considerable force.

Figure 2:
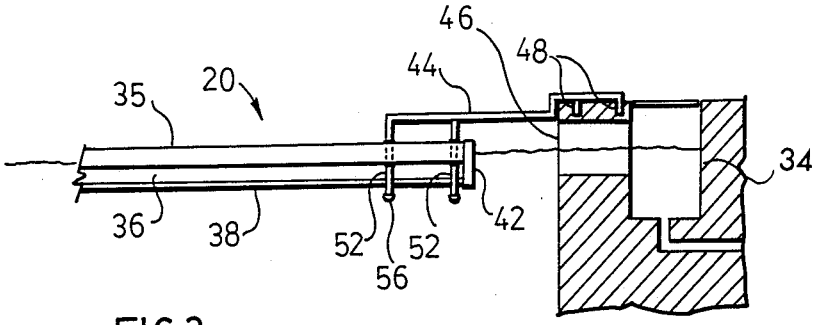
FIG. 2 is a partial cross-sectional of the pool of FIG. 1, taken on the line 2—2, therein.

Referring now also to FIGS. 2 and 3, the boom body is constructed from a thin narrow continuous strip of metal roll formed into the shape of a long, narrow, hollow tube portion 35 of uniform diameter with an integral, long, narrow skirt portion 36 parallel to the tube portion and extending tangentially therefrom. A particularily suitable sheet metal material for this purpose is pre-enameled aluminum sheet of 0.79–0.63 cm (0.031–0.025 ins.) thickness which is non-corrodible and has the desired decorative appearance. The skirt portion extends down into the body of water to ensure that debris is not carried by the current underneath the boom, and also acts as a stabilizing weight to hold the boom in the required attitude with the skirt extending downward. The free edge of the skirt portion is folded back on itself during the roll forming process so that the skirt lower edge 38 is a fold junction with the sharp free edge tucked away from contact by the installer and swimmers. In addition this folded lower edge portion is crimped by the roll forming into a tightly undulating pattern to provide additional rigidity thereto, and to remove the random wrinkling that is created by the folding process. The continuous tube is cut into suitable lengths and a precut length of a suitable flotation material 40 is placed in the hollow tube portion of each boom to provide the necessary flotation without the need to seal the tube against the entry of water.

In the preferred embodiment this flotation material is a single cylindrical piece of closed cell flotation foam of a diameter such that it can easily be pushed into the tube portion 34 from one end. In another embodiment the foam could be expanded in place in the boom interior, but such expandable foams are usually somewhat more expensive than pre-manufactured foams.

The two ends of the boom are provided with plastic caps 42 to cover the sharp free metal edges and prevent human contact therewith, the caps being a sufficiently tight fit to ensure they will not be accidentally knocked off. Each cap is made up of tube and skirt portions and an inner X shaped plug 42B which grips the inside of the tubular portion 35.

Figure 5:
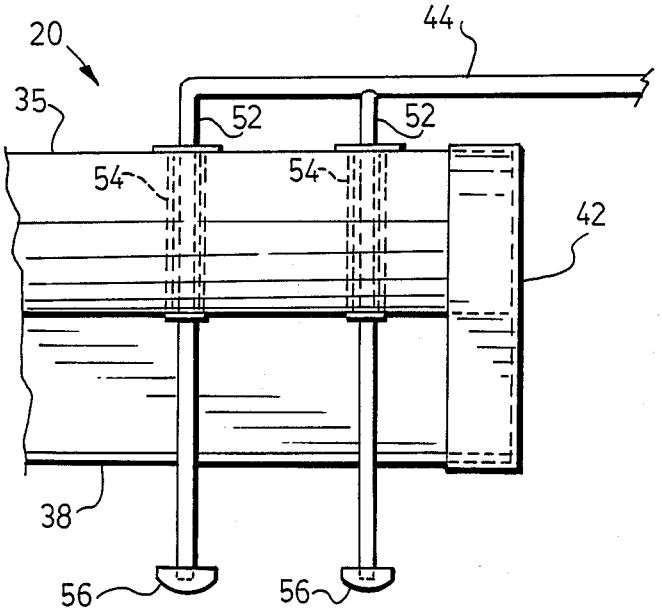
FIG. 5 is an enlarged partial side view of the boom, showing the attachment thereof to a mounting bracket by which it is mounted on the edge of the pool.

The means by which the boom is mounted in the pool also needs to be sturdy and inexpensive, and preferably also provides a certain amount of "give" or "spring", so that the boom will deflect if bumped into by a swimmer without too great a reaction on the swimmer and without the boom being permanently bent. Such means consist of a bracket 44 (FIGS. 4 & 5) which connects the inboard end of the boom to the pool edge 46. The body of the bracket consists of a length of metal rod, such as stainless steel, of sufficient strength and rigidity to hold the floating boom steady, and yet of sufficient flexibility that it will give to the necessary extent if the boom is hit by a swimmer. A suitable size for the rod is about 4.75 mm (0.187 in) diameter. At the pool edge end the bracket rod is connected to the pool edge coping by at least two longitudinally-spaced parallel rods 48, extending vertically downwardly from the bracket into a corresponding number of spaced parallel vertical holes 50 formed in the pool edge, the bracket thus being prevented from moving relative to the pool edge. The portion of the bracket rod between the pool edge end and the boom end is bent at right angles to them, and the holes receiving the rods 48 are located so that this vertical portion abuts closely against the pool edge coping vertical wall 46 to provide additional resistance to movement. The tube end of the bracket rod is provided with at least two longitudinally-spaced, parallel rods 52, extending vertically downwardly from the bracket, which pass freely through a corresponding number of spaced vertical, parallel holes in the tube portion of the boom, so that the boom cannot turn relative to the bracket in a horizontal plane. These rods 52 are of sufficient length to allow the boom to rise and fall with the water level fluctuations to be expected in the average pool. The vertical portion of the rod 44 reduces the length needed for the rods 52. The rods extend through respective plastic bushings 54 placed in the holes in the boom to minimize friction between them and the boom, while friction-fit plastic caps 56 cover the ends of the rods 52 to protect a swimmer who might contact them, and also to prevent the boom from being accidentally detached from the bracket.

Although in the preferred embodiment the tubular body is made of metal in other embodiments it can be of plastic material, and can be extruded. In such an embodiment the end caps seal the interior of the body so that the flotation means is constituted by the air trapped inside the resultant enclosure. The bores through which the rods 52 pass must also be sealed to prevent water entering the body. In a further embodiment the body and skirt are of extruded or foamed material and are integral with one another, the density being sufficient provide the necessary rigidity and buoyancy.

I claim:

1. A debris diverting boom for diverting debris floating on the surface of a body of a liquid circulating in a tank or pool toward the edge thereof said boom comprising:

an elongated hollow tubular body portion and an integral elongated skirt portion roll-formed from an elongated strip of metal, the sharp free edge of the part of the metal strip forming the skirt portion being folded back on itself so that the lower edge of the skirt is constituted by a fold junction;

plastic caps having tube and skirt portions and covering the metal boom ends to cover the sharp free edges of the metal strip;

flotation means within the interior of the hollow tubular body portion and providing sufficient buoyancy to the boom to keep it afloat despite entry of water to the interior; and bracket means engageable with the boom body portion and with the tank or pool edge for holding said boom in place extending across said circulating liquid at an angle to the liquid flow.

2. A debris diverting boom as claimed in claim 1, wherein the folded edge is crimped in a regular pattern.

3. A debris diverting boom as claimed in claim 1, wherein the flotation means is closed cell flotation foam of the same cross-section as the interior of the tubular body portion.

4. A debris diverting boom for diverting debris floating on the surface of a body of a liquid circulating in a tank or pool toward the edge thereof, said boom comprising:

an elongated hollow tubular body portion and an integral elongated skirt portion;

flotation means within the interior of the hollow tubular body portion and providing sufficient buoyancy to the boom to keep it afloat; and bracket means engageable with the boom body portion and with the tank or pool edge for holding said boom in place extending across said circulating liquid at an angle to the liquid flow;

the bracket comprising an elongated member extending lengthwise of the boom and having a boom-engaging portion and a pool-side engaging portion, the member having at its boom-engaging portion at least two longitudinally-spaced parallel rods extending vertically downwardly therefrom to pass through corresponding longitudinally-spaced vertical holes in the boom, thus allowing the boom to rise and fall with the liquid level, but preventing the boom from turning in a horizontal plane relative to the bracket.

5. A debris diverting boom as claimed in claim 4, wherein the said rods extend through respective bushings of plastic material in the boom to minimize friction between the bracket rods and the boom upon vertical movement of the boom on the bracket rods.

6. A debris diverting boom as claimed in claim 4, wherein the bracket comprises an elongated member extending lengthwise of the boom and having at its pool-side engaging portion at least two longitudinally-spaced parallel rods extending vertically downwardly therefrom to pass through corresponding longitudinally spaced vertical holes in the side of the pool or tank to which the boom, is attached, thus preventing the bracket from turning relative to the said side.

7. A debris diverting boom as claimed in claim 6, wherein a portion of the elongated member between the said pool-side engaging portion and the boom-engaging portion is at right angles to the last-mentioned two portions to extend beside the adjacent vertical edge of the pool side.

8. A debris diverting boom as claimed in claim 4, wherein the bracket elongated member is made from stainless steel rod of about 6 mm (0.25 in) diameter.

9. A debris diverting boom for diverting debris floating on the surface of a body of a liquid circulating in a tank or pool toward the edge thereof said boom comprising:

an elongated hollow tubular body portion and an integral elongated skirt portion;

flotation means within the interior of the hollow tubular body portion and providing sufficient buoyancy to the boom to keep it afloat; and bracket means engageable with the boom body portion and with the tank or pool edge for holding said boom in place extending across said circulating liquid at an angle to the liquid flow;

the bracket comprising an elongated member extending lengthwise of the boom and having a boom-engaging portion and a pool-side engaging portion, the member having at its pool-side engaging portion at least two longitudinally-spaced parallel rods extending vertically downwardly therefrom to pass through corresponding longitudinally spaced vertical holes in the side of the pool or tank to which the boom is to be attached, thus preventing the bracket from moving relative to the said side.

10. A debris diverting boom for diverting debris floating on the surface of a body of a liquid circulating in a tank or pool toward the edge thereof said boom comprising;

an elongated tubular body portion of sufficient buoyancy to keep it afloat; and bracket means for holding said boom in place extending across said circulating liquid at an angle to the liquid flow, the bracket means comprising an elongated member extending lengthwise of the boom and having a boom-engaging portion and a pool-side engaging portion, the member having at its boom-engaging portion at least two longitudinally-spaced parallel rods extending vertically downwardly therefrom to pass through corresponding longitudinally-spaced vertical holes in the boom, thus allowing the boom to rise and fall with the liquid level but preventing the boom from turning in a horizontal plane relative to the bracket.

11. A debris diverting boom as claimed in claim 10, wherein the said rods extend through respective bushings of plastic material in the boom to minimize friction between the bracket rods and the boom upon vertical movement of the boom on the bracket rods.

12. A debris diverting boom as claimed in claim 10, wherein the bracket comprises at its pool-side engaging portion at least two longitudinally-spaced parallel rods extending vertically downwardly therefrom to pass through corresponding longitudinally-spaced vertical holes in the side of the pool or tank to which the boom is to be attached, thus preventing the bracket from moving relative to the said side.

13. A debris diverting boom as claimed in claim 12, wherein a portion of the elongated member between the said pool-side engaging portion and the boom engaging portion is at right angles to the last-mentioned two portions to extend beside the adjacent vertical edge of the pool side.

14. A debris diverting boom as claimed in claim 10, wherein the bracket elongated member is made from stainless steel rod of about 6 mm (0.25 in) diameter.

15. A debris diverting boom as claimed in claim 10, and including a downwardly extending skirt portion formed as an integral part of the boom to prevent debris from passing beneath the boom.

16. A debris diverting boom as claimed in claim 15, wherein the tubular body portion and the elongated skirt portion are integral and formed from a strip of metal.

17. A debris diverting boom as claimed in claim 16, wherein the free edge of the part of the metal strip forming the skirt portion is folded back on itself, so that the lower edge of the skirt is constituted by a fold junction.

18. A debris diverting boom as claimed in claim 17 wherein the folded edge is crimped in a regular pattern.

19. A debris diverting boom as claimed in claim 15, wherein the tubular body portion and the elongated skirt portion are integral and formed from a strip of metal by roll-forming.

* * * * *